US006893295B1

(12) United States Patent
Lloyd et al.

(10) Patent No.: US 6,893,295 B1
(45) Date of Patent: May 17, 2005

(54) CONNECTOR WITH INTEGRATED STRAIN RELIEF

(75) Inventors: Brian Keith Lloyd, Maumelle, AR (US); Michael J. Miskin, Little Rock, AR (US); Michael F. Magajne, Cicero, IL (US); Edward Seamands, Little Rock, AR (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/747,012

(22) Filed: Dec. 23, 2003

(51) Int. Cl.[7] ..... H01R 9/03
(52) U.S. Cl. ..... 439/610; 439/465
(58) Field of Search ..... 439/610, 465, 439/457, 606

(56) References Cited

U.S. PATENT DOCUMENTS 4,602,831 A 7/1986 Lockard
4,860,445 A 8/1989 Jones
5,038,001 A 8/1991 Koegel et al.
5,964,620 A 10/1999 Takahashi et al.
5,990,420 A 11/1999 Alexander
6,203,376 B1 3/2001 Magajne et al.
6,305,978 B1 10/2001 Ko et al.
6,726,503 B2 * 4/2004 Waddell et al. ..... 439/465
6,758,694 B2 * 7/2004 Liu ..... 439/606

* cited by examiner

*Primary Examiner*—Tho D. Ta
(74) *Attorney, Agent, or Firm*—Thomas D. Paulius

(57) ABSTRACT

A connector for connecting cables to a pin header has a connector body portion that incorporates a strain relief member applied to the cables as part of the connector body portion. The strain relief member includes a cable clamp having a series of grooves that are separated by intervening land portions. The grooves receive the cables and particularly space them. A stop is formed in the clamp to isolate the cable end. The leads of the cable are terminated to corresponding tail portions of contacts of the connector. These tail portions are maintained in the same plane to enhance the electrical performance of the connector. An insulative material is molded over the tail portions and the cable clamp to form a connector with a cable clamp formed integrally with the body of the connector.

19 Claims, 6 Drawing Sheets

CONNECTOR WITH INTEGRATED STRAIN RELIEF

BACKGROUND OF THE INVENTION

The present invention relates generally to cable connectors, and more particularly to cable connectors used in high speed applications with a strain relief means integrated into the connector structure.

Many connectors are known in the art for connecting cables to backplane assemblies. Most of these connectors are assembled from numerous components and include contact terminals, ground plates and housings. The contact terminals and ground plates and their points of connection to the cables are maintained in different planes, as exemplified by the connector construction described in U.S. Pat. No. 4,602,831, issued Jul. 29, 1986. The different planes of these termination points increases the difficulty in welding or soldering the cable leads to the termination tails of the connector and thereby increases the cost of manufacturing these connectors. Also, this double-plane arrangement lends itself to increased electrical interference between signal wires of the cable in the form of crosstalk. Additionally, prior art connectors utilize the strain relief members that are separately attached to the cables aft of and spaced apart from the connector body.

U.S. Pat. No. 6,203,376, issued to Magajne et al. And assigned to the assignee of the present invention, describes a wafer connector that has a connector body portion with a strain relief member applied to the cables as part of the connector body portion. The strain relief member is a cable clamp having a series of grooves which receive the cables and particularly space them. An insulative material is molded over the tail portions and the cable clamp to form a connector with a cable clamp formed integrally with the body of the connector. One disadvantage of this connector is that, during the overmolding process, the dielectric material within the cable is compressed from the injection molding pressure. The molding material may bleed into the cable and collapse the dielectric and the internal shield wrapping, or it may escape from the end walls of the mold into the area between the cables leading to the connector. As a result, there is a high product scrap rate and reduced electrical performance due to shorts caused from the high molding pressure. The conductors are also difficult and slow to align in the correct position for termination.

The present invention is directed to an improved cable connector that overcomes the aforementioned disadvantages.

SUMMARY OF THE INVENTION

Accordingly, it is a general object of the present invention to provide an improved cable connector with enhanced electrical performance characteristics for use in cable wafer connector applications.

It is another object of the present invention to provide a connector for connecting a series of cables to an array of conductive pins in which the individual wires of the cables are maintained and terminated in the same plane and in which the signal wires thereof are flanked by ground wires so as to enhance the electrical performance of the connector.

A further object of the present invention is to provide a cable with connector assembly that enclosed a plurality of conductive pin contacts to which a number of individual wires are terminated, the wire terminations being effected in substantially the same plane to enhance the electrical performance thereof, the cables being spaced together by a cable positioning member, the connector assembly further having a housing that is molded over the positioning member so that the positioning member forms part of the housing, and the positioning members having a structure that provides an effective "dam" or blockage to molding material to thereby prevent the molding material from bleeding out of the desired perimeter of the connector housing.

A still further object of the present invention is to provide an integrated cable connector having a plurality of signal and ground contacts maintained in a pre-selected spacing within an insulative connector housing, the contacts having tail portions that are maintained in alignment with each other in a pre-selected, single plane, the connector including a series of cables having individual signal and ground wires each one respectively terminated to the tail portions, the cables being held in a preselected spacing by a clamping, or positioning, member that is integrally molded to the connector housing and which serves as a strain relief for the cables exiting the connector housing.

In accordance with these objects, the present invention provides in one principal aspect an improved wafer connector structure having a connector body portion that supports, on one side thereof, a plurality of signal contacts and on another side thereof, a ground shield. The signal contacts and ground shield have tail portions that extend rearwardly of the connector body portion. In the preferred embodiment, the tail portions of the ground contacts are flat in their extent and lie in a common plane, while the tail portions of the ground signal shield are also flat and further are bent so that they lie in the same place as the signal contact tail portions. This coplanar configuration simplifies the process of attaching the cable wires to the tails.

The tail portions of the signal and ground contacts are arranged in an alternating fashion so that, if desired, each signal contact or pair of signal contacts may be surrounded by a ground tail portion so as to reduce the likelihood of crosstalk from occurring in the connector. In another important aspect of the present invention, the cable wire connection area is over-molded, or "potted", in order to extend the connector housing from its body portion over the conductors and the clamp member.

A cable clamp holds the cables and conductors in a preferred spacing and provides strain relief during the overmolding process and in the completed connector. The cable clamp in one embodiment takes the form of a two-piece insert that is applied to the cables and, in this regard, has grooves formed therein that receive the cables. A stop is formed on the cable clamp with guides formed therein so that the conductors extend therethrough in particular alignment and the cable end is protected during the overmolding process. The clamp is inserted into the mold, after attachment to the cables and termination of the wires to the tail portions. The extension of the connector housing is then molded over it, and the termination points of the cable wires, thereby joining the separate cable clamp and the contact assembly together into an integral connector body.

These and other objects, features and advantages of the present invention will be clearly understood through consideration of the following detailed description.

BRIEF DESCRIPTION OF THE DRAWINGS

In the course of this description, reference will be made to the attached drawings in which.

DETAILED DESCRIPTION OF THE PREFERRED EMBODIMENTS

Figure 1:
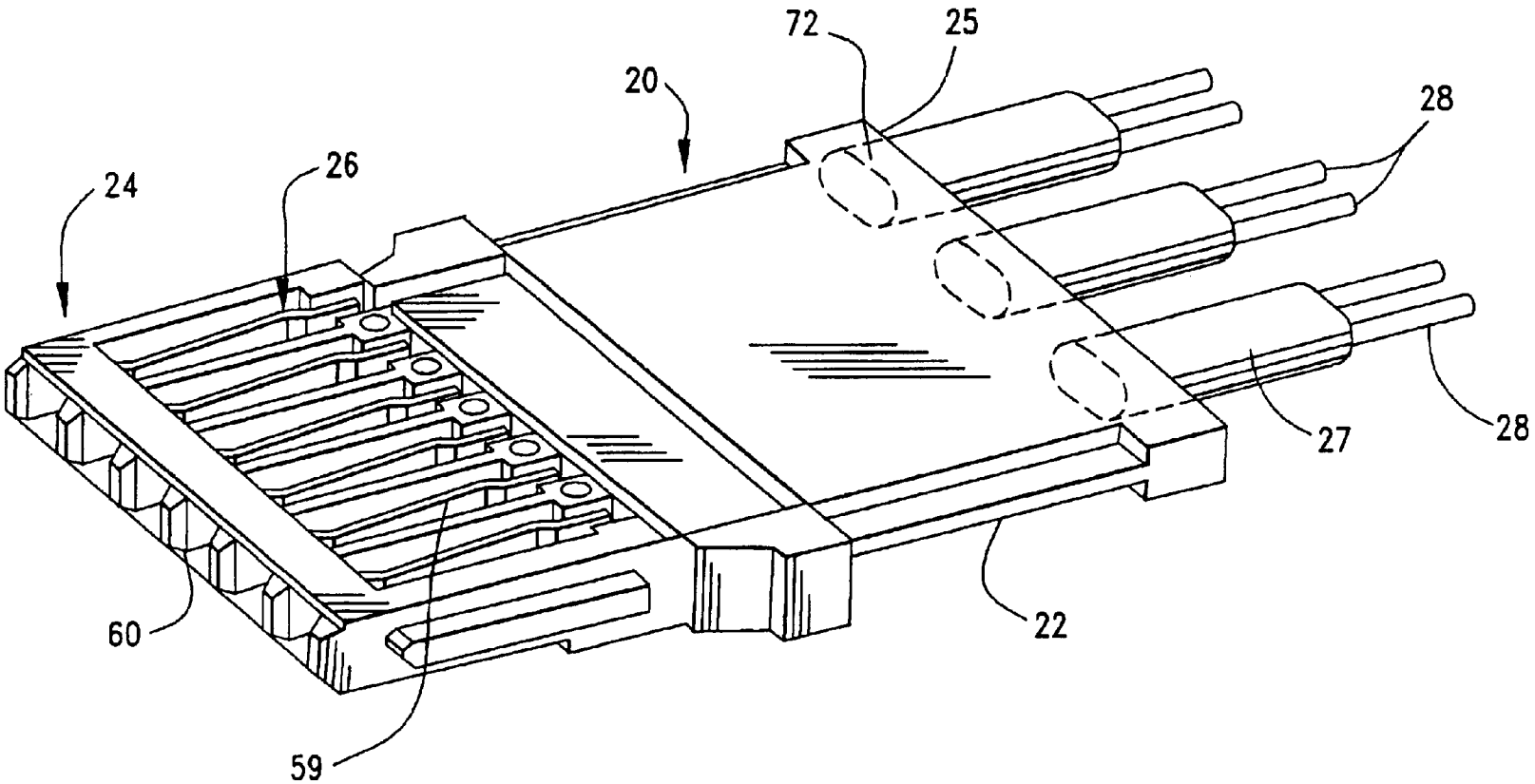
FIG. 1 is a perspective view of a wafer connector constructed in accordance with the principles of the present invention.

As noted earlier, the present invention pertains to an improved connector. Such a connector is shown generally at 20 in FIG. 1. The connector 20 has an elongated body portion 22 that is formed from an electrically insulative material, and preferably a dielectric material such as a plastic. The body portion 22 has defined front and rear portions 24, 25, with the front portion 24 including a plurality of conductive contacts 26 that are arranged in a preselected spacing therein so as to accommodate corresponding conductive pins of an opposing, mating connector, typically a backplane or pin header connector (not shown) in which an array of pins project outwardly therefrom. The rear portion 25 holds a plurality of multi-wire cables 27, each containing one or more wires 28.

Figure 2:
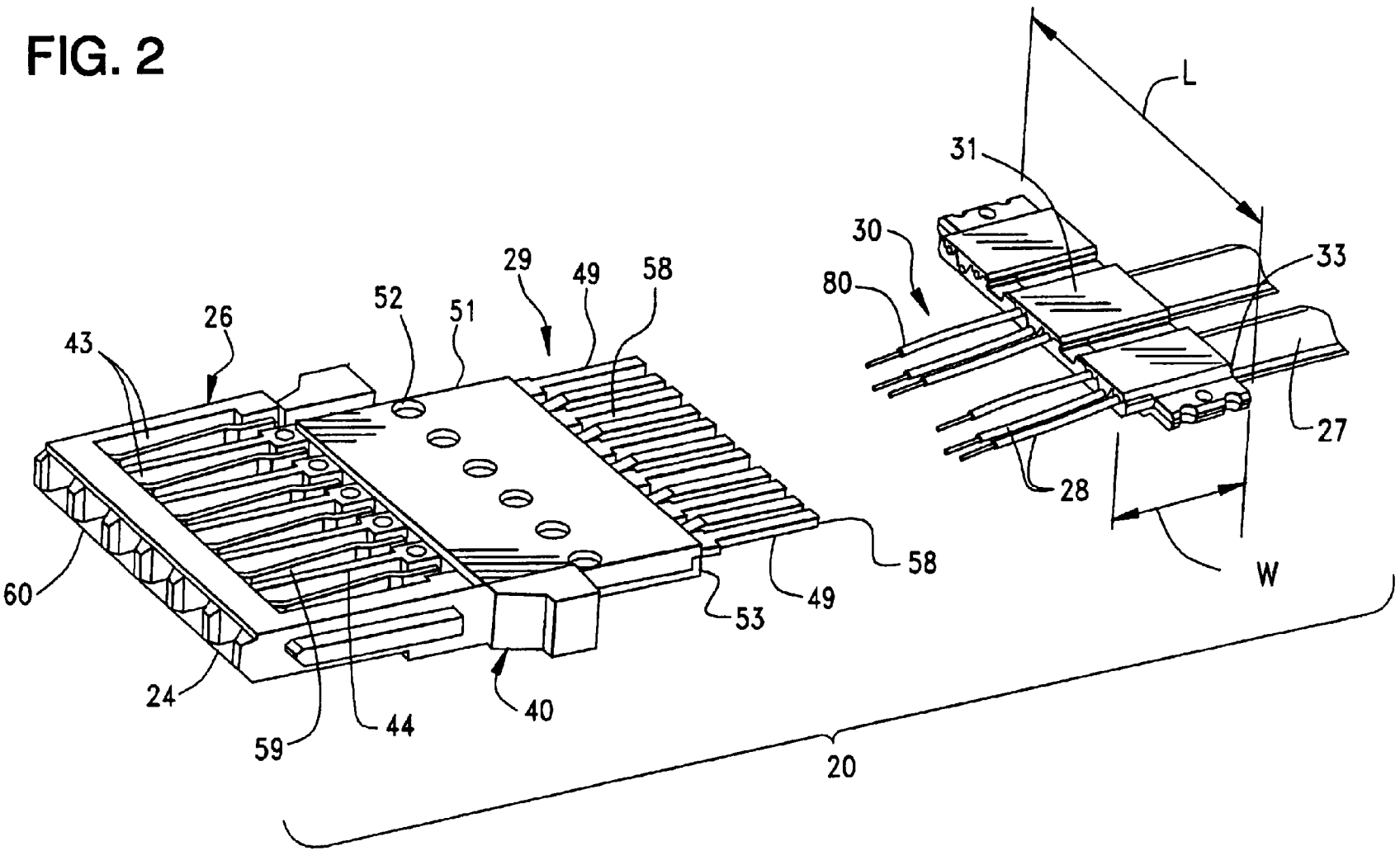
FIG. 2 is an exploded view of a wafer subassembly and a set of wire-containing cables held by a cable clamp or retainer shown separated from the wafer subassembly.

As shown in FIG. 2, the cables 27 are aligned with their corresponding connector contact assembly 29 and then are attached thereto. The overall connector body portion is subsequently molded over the contact assembly 29 and a portion of the cable assembly 30. Thus, the finished connector 20 maybe considered as the union of two different, and separate assemblies: a contact assembly 29 and a cable assembly 30.

Figure 3A:
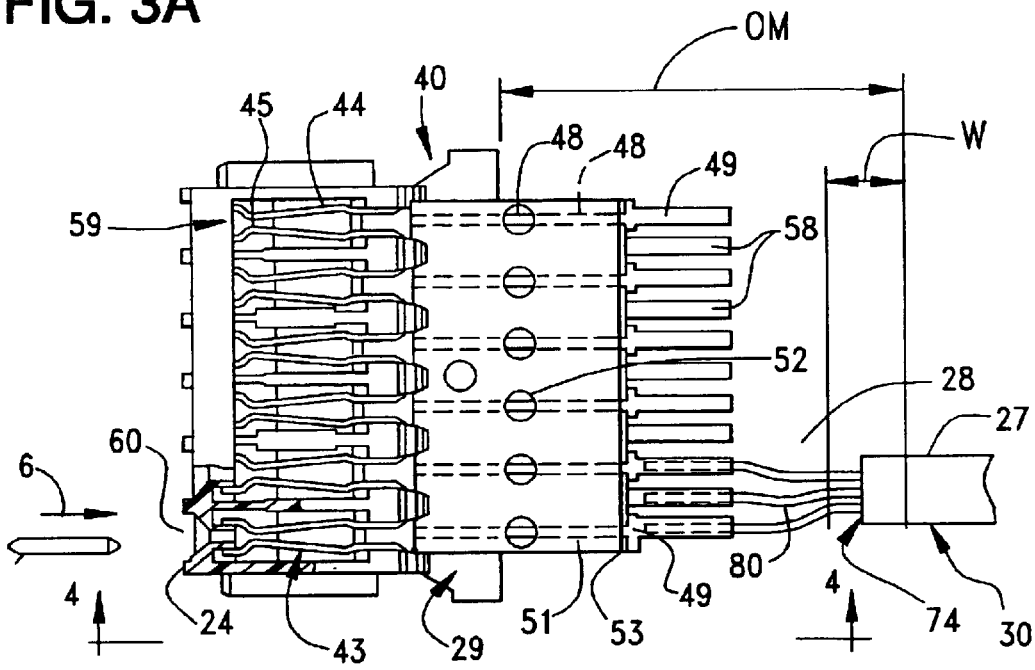
FIG. 3A is a top plan view of the wafer subassembly of FIG. 2 with a cable shown aligned and in contact therewith.
Figure 5:
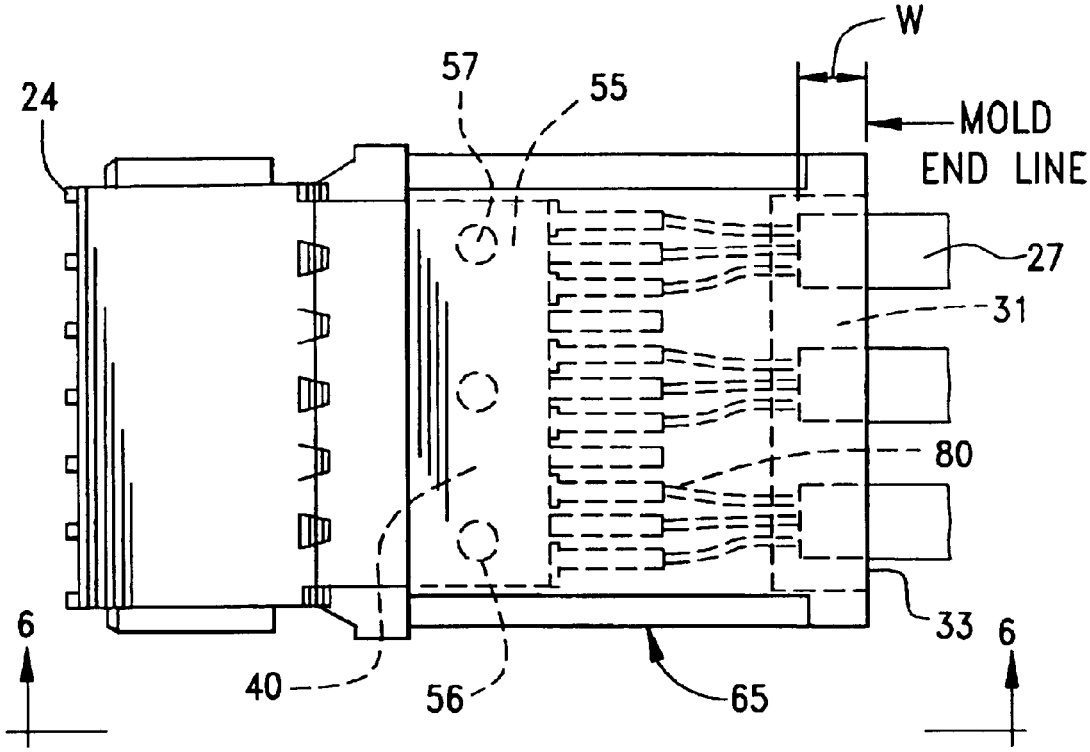
FIG. 5 is a top plan view of the wafer connector of FIG. 1 showing the position of the cables molded within the wafer connector body.
Figure 6:
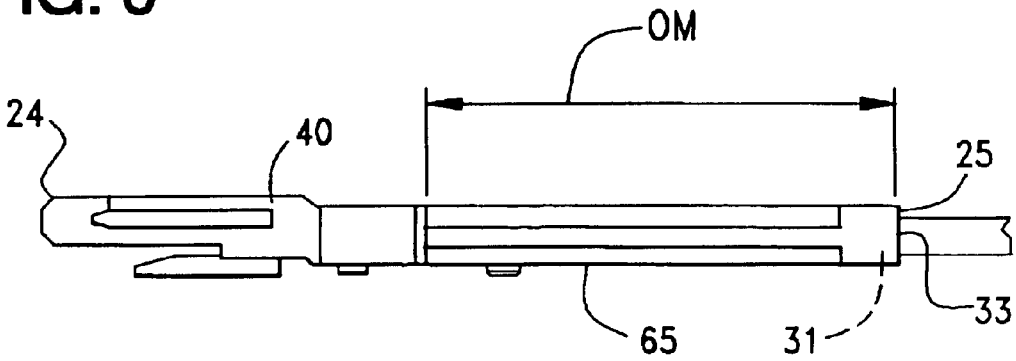
FIG. 6 is a side elevational view of the wafer connector of FIG. 5 taken along lines 6—6 thereof.
Figure 7:
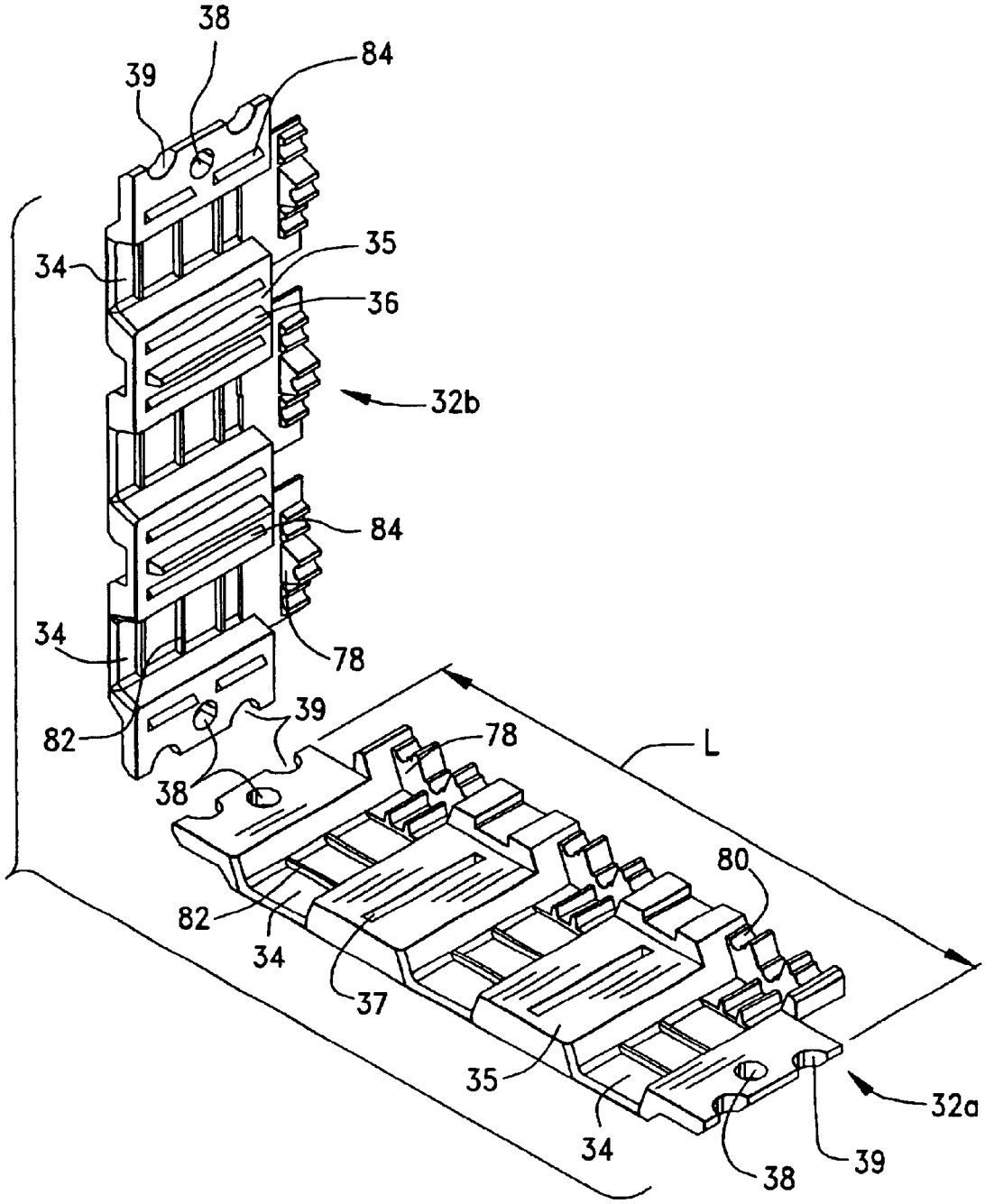
FIG. 7 is a perspective view of each portion of a cable clamp, or retainer, used in the wafer connector of FIG. 1.
Figure 8:
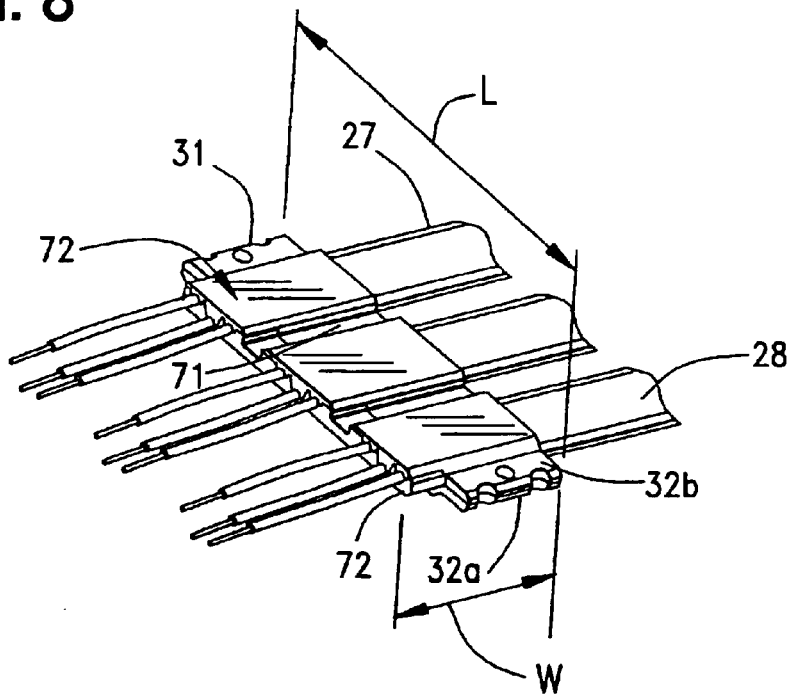
FIG. 8 is a perspective view of a cable clamp similar to that of FIG. 7 that has been applied to three cables and with the two half portions of the cable clamp connected to maintain the cables in a particular position and spacing.

In the cable assembly 30, a plurality of multi-wire cables 27 are held together in a preselected spacing by way of a cable clamp or retainer 31 formed of a material compatible for overmolding, such as a plastic and which positions the cables in a side-by-side order as shown. FIGS. 7 & 8 illustrate such member at 31 and the cable clamp 31 shown in FIG. 7 includes two opposing, inter-engaging halves 32*a*, 32*b* that are designed for easy engagement with each other. In this regard, and as illustrated in FIG. 7, the cable clamp halves 32*a*, 32*b* each have a series of grooves 34, with three such grooves 34 being illustrated, that are separated from each other by intervening land portions 35. The grooves 34 extend a certain width W of the clamp 31 which is less than the total width. A cable end (74, as shown in FIGS. 3A and 5) is disposed adjacent a stop 78 and preferably abuts support ribs 76 disposed in each of the grooves 34. The cable clamp 31 further includes a stop 78, that is shown generally configured as a front wall, having at least one wire guide 80 defined therein. The grooves 34 formed in each half 32*a*, 32*b* and the stop 78 cooperatively define a receptacle for receiving the cable end 74 and isolating such cable end 74 during subsequent overmolding as described below. In this embodiment, a portion of the stop 78 and each guide 80 is formed on each cable clamp half 32*a*, 32*b* such that the stop 78 on each cable clamp half 32*a*, 32*b* has a complementary contour for orienting and mating the cable clamp halves 32*a*, 32*b* together and thereby defining the guides 80.

Each conductor has a respective wire guide 80 formed in the two halves 32*a*, 32*b* of the cable clamp 31. In this embodiment, three wire guides 80 are associated with each cable groove 34. Accordingly, each cable has three conductors in this embodiment. Each conductor extends through its respective guide 80 such that when the first and second half portions 32*a*, 32*b* are connected each conductor and guide 80 cooperatively seal the guide 80 and stop 78 such that the trimmed cable end s74 (FIGS. 1 & 3A) are isolated during the overmolding process. As a result, disadvantages of the prior art are overcome.

Each groove 34 preferably includes at least one transverse rib 82. In this embodiment, the first half portion 32*a* has two transverse ribs 82 formed therein and the second half portion 32*b* has three transverse ribs 82 formed therein. Each transverse rib 82 on the first half portion 32*a* is offset from each transverse rib 82 formed on the second half portion 32*b*. Such configuration cooperatively creates a tortuous path which not only grips the cable, but also provides strain relief.

The raised land portions 35 preferably include, as illustrated, means for orienting and mating the two halves 32*a*, 32*b* together such as alignment lugs 36 and corresponding recessed opening 37 for receiving the alignment lugs 36. The alignment lugs 36 and opening 37 are located in the wider interior lands, while the thinner, exterior lands may include alignment apertures 38 and notches 39. These sets of alignment elements assist in holding the cables 27 in place therein and the two halves 32*a*, 32*b* together during assembly. The halves 32*a*, 32*b* are preferably fixed together by any suitable means, such as ultrasonic welding, plastics welding, heat welding, adhesives or the like. In this regard, the lugs 84 aptly serve as energy directors when ultrasonic welding or other similar means of joining is used.

Figure 10:
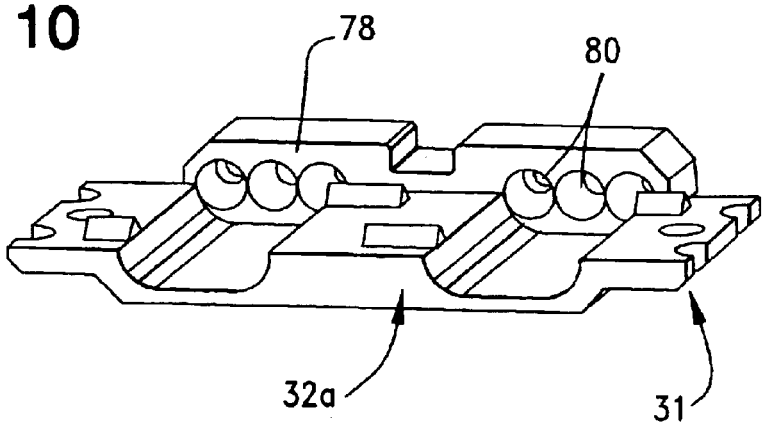

In this embodiment, the stop 78 is partly formed on each of the two halves 32*a*, 32*b*. The distal end of each portion of the stop 78 formed on each half 32*a*, 32*b* defines an engaging complimentary contour. These engaging contours correctly align the halves 32*a*, 32*b* relative to one another. It is within the teaching of this invention that the stop 78 may also be integrally formed as a one-piece element on either of the two halves 32*a*, 32*b* such that the guides 80 are defined as bores through the stop 78, as illustrated in FIG. 10.

Importantly, the cable clamp 31 may be made in strips of varying length and then trimmed to a desired sublength L in order to fit the number of cables 27 needed in the particular connector application, or the clamp may be formed by way of a long mold cavity within pairs of opposing mold blocks. Additionally, as will be explained in greater detail below, the clamp 31 is easily inserted into a mold and the finished connector body is molded over it. In its location proximate to the rear end 25 of the connector 20, when the final connector body is molded over the contact assembly 24, the clamp 31 serves as a strain relief for the cables 27 and also assists in defining a portion of the rear end 25 of the connector 20. The alignment apertures 38 and/or notches 39 may engage devices when placed in the mold to properly orient the cable clamp 31 for the over-molding process. The notches 39 may also be used to locate the wires when attaching them to the connector tail portions 58. Further, overmolding the alignment apertures 38 aids in integrating the cable clamp 31 into the connector 20 and with strain relief for the connector 20.

The cable clamp illustrated in FIG. 8 differs from the one illustrated in FIG. 7 in that it has a specifically configured exterior surface 72 with groove or valley portions 71 separated by intervening land portions 70.

Turning now to FIG. 3A, a contact assembly 29 used in the connector 20 is illustrated in a top plan view, and partially in section. The contact assembly 29 includes an insulative frame, or support member 40 that supports a plurality of individual conductive contacts 43 that may be stamped or otherwise formed, with each contact having a pair of contact arms 44 with contact faces, or points 45, that are disposed within channels and spaced apart from each other a preselected distance less than the width, thickness or diameter of a corresponding pin, or male contact member 46 (shown to the left of FIG. 3A). In this manner, engagement of the contact assembly 29 with a like number of pins 46 will cause the contact arms 44 to spread slightly apart under urging of the pins 46. The contact arms 44 will engage the pins 46 at their contact faces 45 by virtue of their springiness and their initial closely-spaced configuration. Slots 60 may be formed in the front end 24 of the connector 20 that communicate with the channels 59 of the support member 40. These slots 60 communicate with an open at the front end 24 of the connector 20 so as to permit the entrance therein of conductive male contact members 46 of an opposing connector (not shown).

Each contact 43 extends rearwardly and includes elongated leg portions 48 that terminate in tail portions 49. The leg portions 48, as are the contacts 43 in their entirety, are separate from the leg portions 48 of adjacent contacts 43 so that a single tail portion 49 is associated with a single contact 43. A separation member, illustrated in the form of a plate member 51 serves to hold the contacts 43 together in a preselected alignment within a like number of channels 59. Openings 52 may be provided in the plate member 51 to allow the pins of the mold to hold the contact leg portions 58 in place during molding. The tail portions 49 of these "signal" contacts 43 extend past the rear face 53 of the plate member 51 for a specific distance to permit the leads from the cable wires 28 to be terminated to the corresponding tail portions 49. (FIG. 3A.)

Figure 3B:
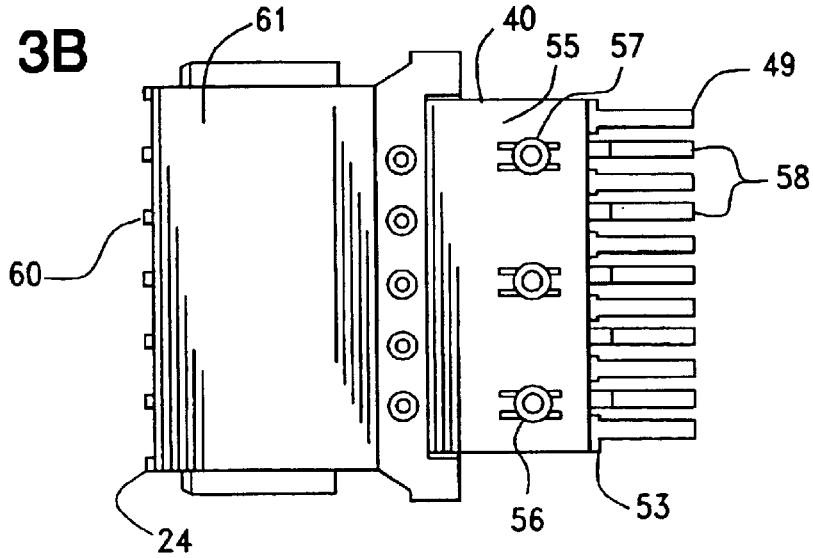
FIG. 3B is a bottom plan view of the wafer subassembly of FIG. 2.

On the other side of the contact assembly 29, as illustrated in FIG. 3B, a grounding or shielding member, in the form of a conductive plate 55 is provided. This grounding plate 55 has a series of openings 56 formed therein that receive, in an interference-type fit, a like series of posts 57 disposed on the other side of the plate member 51. A plurality of tail portions 58 are formed with the grounding plate 55 (and may be stamped and formed from the same plate 55) and extend rearwardly therefrom and past the rear face 53 of the plate member 51. These tail portions 58 are oriented in a preselected pattern so that they extend within the intervening spaces between adjacent tail portions 49 of the signal contacts 43.

Figure 4:
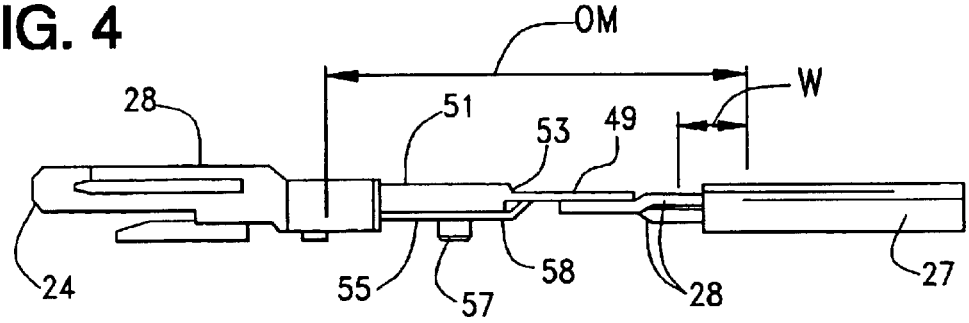
FIG. 4 is a side elevational view of the assembly of FIG. 3A taken along lines 4—4 thereof.

The grounding plate 55 further extends toward the front face 60 of the contact assembly 29 as at 61, to provide beneficial signal isolation of the signal contacts 43. As illustrated in FIG. 4, the grounding plate tail portions 58 are bent in a slightly offset manner so that they are aligned with and preferably lie in the same plane as the contact tail portions 49. This coplanarity is illustrated in FIG. 11. This coplanar arrangement facilitates the welding, or soldering of the wire leads of the individual signal wires 28 and the grounding shields 80 of the cables 27. Additionally, this coplanar arrangement reduces crosstalk, or interference, between the signal contacts 43 because the grounding and signal contact tail portions 58, 49 are disposed at the same level, and not raised or lowered in an alternating fashion, as is present in the prior art, which arrangement induces some crosstalk and this arrangement further improves the impedance discontinuity that occurs in connectors such as these.

In assembling the connector 20, the leads of the cable conductor wires 28 are attached to the tail portions 49, 58 in any suitable manner, such as adhering, welding or soldering. In this process, the conductor signal leads are preferably attached to their corresponding signal contact tail portions 49 and the conductor grounding shields are attached to their corresponding grounding tail portions 58 in an alternating signal-ground-signal-ground arrangement so as to ensure proper signal isolation.

In one embodiment of the present invention, the cable clamp 31 may be applied to the wires 28 prior to their attachment to the contact assembly 29. In the second embodiment of FIG. 10, the cable clamp 31 must be applied to the wires 28 prior to their attachment to the contact assembly 29 (FIG. 10). When attached, the clamp 31 and guides 80 specifically align the individual cables in a proper pitch for termination. The cable clamp 31 is spaced apart from the contact assembly 29 so that an intervening space is defined therebetween. The tail portions of the contact assembly 29 and the termination ends of the cable wires and grounding members extend into this intervening space.

The cable clamp 31 and contact assembly 29 may then be inserted as an entire assembly into a mold and what may be considered as an insulative extension, or bridging portion 65, of the overall connector body portion 22 is over-molded onto the contact assembly and its associated plate member 51. This extension 65 is molded over the tail portions and the plate member 51. It also is molded over the cable assembly 30 and its associated cable clamp 31, and therefore interconnects the cable clamp 31 to the support member 40 in an integral manner.

This over-molding occurs generally along the extent indicated at "OM" in FIGS. 3 & 4 and serves to encapsulate the leads of the cable conductor wires 28 and their attached tail portions 49, 58. The additional insulative material from which this extension or bridging portion is molded will fill the intervening space between the cable clamp 31 and the support member 40 and, in essence, encapsulate the terminations between the cable wires and grounding members and the tail portions 49, 58. The stop 78 functions to isolate the cable ends during the overmolding process. In particular, the guides are configured such that they are approximately the same size or slightly smaller than the individual conductor wires to create a seal which prevents the overmolding material from entering the receptacle cooperatively defined by opposing grooves 34 and collapsing the dielectric of the cable which may cause a short to ground resulting in useless connectors, or which may result in spreading the wires out of alignment. The guides may also be tapered from a rear wall of the stop 78 to aid in insertion and alignment of the conductors.

Figure 9:
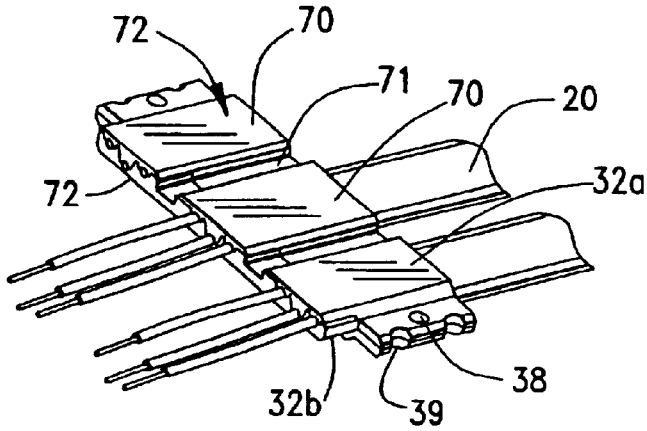
FIG. 9 is a perspective view of another embodiment of the cable clamp of FIG. 8; and, FIG. 10 is a perspective view of another embodiment of a cable clamp used in wafer connectors of the present invention.

During the assembly process, the cable clamp 31 serves as a strain relief member for the cables 27, as well as shutoff in a mold. It also assists in properly positioning the contact 15; and cable assemblies 29, 30 in the mold cavity in as much as the rear face 33 of the clamp 31 may be placed in the mold cavity so that it may extend coincident with a rear wall of the mold cavity, as illustrated in FIG. 5. The resultant connector 20 integrates the cable clamp 31 into its body portion 22. To assist in this integration and as illustrated in FIG. 9, the cable clamp 31 also may have exterior land portions 70 that are separated by intervening groove or valley portions 71. These valleys 71 will receive the molding material so that it bonds with the cable clamp 31 to result in a structurally sound connector body portion 22. Additionally, the exterior land portions 70 will serve to define part of the overall exterior surfaces 79 of the final connectors 20.

While the preferred embodiments of the invention have been shown and described, it will be appreciated by those skilled in the art that changes and modifications may be made to these embodiments without departing from the spirit of the invention, the scope of which is defined by the appended claims.

What is claimed is:

1. An electrical cable connector, comprising:

a connector housing which includes a rear wall; a plurality of electrical conductive terminals disposed within said connector housing, a connector support member formed from an insulative material, the support member having first and second support surfaces and further having opposed first and second ends; an electrical contact assembly having a plurality of conductive signal terminals disposed on the support member first surface, each of the signal terminals having a contact portion and an elongated first tail portion extending lengthwise therefrom and past said support member second end; a grounding assembly having a shielding plate disposed on the support member second surface, the shielding plate having a plurality of second tail portions extending lengthwise past said support member second end, said shielding plate second tail portions and said contact first tail portions lying in a common plane;

a plurality of cables maintained in a spaced-apart relationship, rearwardly of said support member by a clamp member, the clamp member being formed from an insulative material including a stop having at least one guide defined therein, each of the cables containing at least one conductor which extends from a cable end and is electrically connected to one of said first and second tail portions, the cables extending through said connector housing rear wall so that the cable end is disposed adjacent the stop and each at least one conductor extends through one of the at least one guides; and, a bridging portion formed from an insulative material molded to said support member and said clamp member, the bridging portion extending between said support member and said clamp member, said bridging portion encompassing both at least a portion of said support member and said clamp member, said bridging portion joining said support member and said clamp member integrally together into said connector housing, and said connector housing rear wall being cooperatively formed by at least a part of said clamp member and at least a part of said bridging portion.

2. The connector as set forth in claim 1, wherein said bridging portion is molded over a portion of said support member, a portion of said clamp member and said first and second tail portions, said bridging portion encapsulating said first and second tail portions.

3. The connector as set forth in claim 1, wherein said support member includes a plurality of channels disposed on said first surface, each of said channels receiving one of said contacts therein, and said shielding member including a plate portion extending across said support member second surface.

4. The connector as set forth in claim 1, wherein each at least one conductor extending through one of the at least one guides seals the guide such that the cable end is isolated from the bridging portion.

5. The connector as claimed in claim 1, wherein said clamp member and said support member are spaced apart from each other by an intervening space, both of said signal contact and ground contact tail portions and said cable conductors extending into said intervening space, said body portion extending between said support member and said clamp member and filling said intervening space to thereby encapsulate said signal and ground contact tail portions and said cable conductors.

6. The connector as set forth in claim 1, wherein said clamp member includes an elongated base portion extending for approximately a width of said connector housing, the clamp member base portion having a series of grooves formed therein, each of said grooves accommodating at least a single cable therein.

7. The connector as set forth in claim 6, wherein said clamp member base portion includes first and second half portions, the first and second half portions each respectively including a first and second stop portion each such first and second stop portion having a complementary contour for orienting and mating said two half portions together.

8. The connector as set forth in claim 7, wherein each of said grooves formed in the first and second half portions includes at least one rib and each at least one rib on the first half portion is offset from each at least one rib on the second half portion.

9. An electrical connector assembly, comprising:

a contact assembly including an insulative support member having a plurality of signal contact members disposed on a first side of the support member, and a ground contact member disposed on a second and opposite side of said support member, said support member having opposing first and second ends, the signal contacts being arranged in spaced-apart order proximate to said support member first end, said signal contact members further having tail portions arranged proximate to and extending beyond said support member second end, said ground contact member having a plurality of tail portions arranged proximate to and extending past said support member second end, said signal and ground contact tail portions being further arranged in a substantially common plane;

a plurality of cables, each having, extending from a cable end, at least one signal wire with a signal wire termination end and one grounding member with a grounding member termination end extending throughout a length of the cable, the cable signal wire termination ends electrically connected to said signal contact tail portions and the cable grounding member termination ends being electrically connected to said ground contact member tail portions;

a clamp member applied to said cables for holding said cables in a predetermined spacing said clamp member including a base portion, a plurality of grooves formed therein separated by land portions and a stop having at least two guides defined therein, said clamp member spaced rearwardly of said support member second end, and one of the plurality of cables disposed in each groove such that each cable end is disposed adjacent the stop and each signal wire and grounding member extends through one of the at least two guides; and, an insulative body portion molded over at least part of said support member and said clamp member to cooperatively define a connector housing, the connector housing encapsulating said signal and ground contact tail portions and said cable signal wire and grounding member termination ends, thereby insulating said signal and ground contact tail portions and said cable signal wire and grounding member termination ends from each other.

10. The connector as claimed in claim 9, wherein said clamp member includes an end wall that forms part of an end wall of said connector housing, said clamp member end wall being capable of engaging an opposing surface of a mold cavity.

11. The connector as claimed in claim 9, wherein said clamp member two half portions include exterior surfaces, said clamp member half portions exterior surfaces serving to at least partially define portions of exterior surfaces of said connector body.

12. The connector as claimed in claim 9, wherein said clamp member and said support member are spaced apart from each other by an intervening space, both of said signal contact and ground contact tail portions and said cable signal wire and grounding member terminations ends extending into said intervening space, said body portion extending between said support member and said clamp member and filling said intervening space to thereby encapsulate said signal and ground contact tail portions and said cable signal wire and grounding member termination ends.

13. The connector as set forth in claim 9, wherein each signal wire and grounding member extending through one of the at least two guides seals the stop and the guide such that the cable end is isolated from the insulative body portion.

14. The connector as claimed in claim 9, wherein each of the guides tapers from a rear end having a dimension greater than said cable signal wire termination ends and said grounding member termination ends to a front end having a dimension approximately the same as the said cable signal wire termination ends and grounding number termination ends.

15. The connector as claimed in claim 14 wherein the front end has a dimension less than said cable signal wire termination ends and grounding member termination ends.

16. The connector as set forth in claim 9, wherein said clamp member includes an elongated base portion extending for approximately a width of said connector housing, the clamp member base portion having a series of grooves formed therein, each of said grooves accommodating at least a single cable therein.

17. The connector as set forth in claim 16, wherein said clamp member base portion includes first and second half portions, the first and second half portions each respectively including a first and second stop portion each such first and second stop portion having a complementary contour for orienting and mating said two half portions together.

18. The connector as set forth in claim 17 wherein each of said grooves formed in the first and second half portions includes at least one rib and each at least one rib on the first half portion is offset from each at least one rib on the second half portion.

19. An electrical connector assembly, comprising:

a contact assembly including an insulative support member having a plurality of signal contact members disposed on a first side of the support member, and a ground contact member disposed on a second and opposite side of said support member, said support member having opposing first and second ends, the signal contacts being arranged in spaced-apart order proximate to said support member first end, said signal contact members further having tail portions arranged proximate to and extending beyond said support member second end, said ground contact member having a plurality of tail portions arranged proximate to and extending past said support member second end, said signal and ground contact tail portions being further arranged in a substantially common plane;

a plurality of cables, each having, extending from a cable end, at least one signal wire with a signal wire termination end and one grounding member with a grounding member termination end extending throughout a length of the cable, the cable signal wire termination ends electrically connected to said signal contact tail portions and the cable grounding member termination ends being electrically connected to said ground contact member tail portions;

a clamp member applied to said cables for holding said cables in a predetermined spacing said clamp member including a base portion, a plurality of grooves formed therein separated by land portions and a stop having at least two guides defined therein, said grooves and said stop cooperatively define a receptacle having a front end adjacent the stop; the cable end is disposed within the receptacle; cable signal wire termination ends and grounding member termination ends extend from the cable end through the guides formed in the stop for electrical connection with the signal contact and ground contact tail members; said cable signal wire termination ends and grounding member termination ends cooperate with the guides to seal the front end of the receptacle; and, an insulative body portion molded over at least part of said support member and said clamp member to cooperatively define a connector housing, the connector housing encapsulating said signal and ground contact tail portions and said cable signal wire and grounding member termination ends, thereby insulating said signal and ground contact tail portions and said cable signal wire and grounding member termination ends from each other, and wherein, each of said guides tapers from a rear end having a dimension greater than said cable signal wire termination ends and said grounding member termination ends to a front end having a dimension approximately the same as the said cable signal wire termination ends and grounding number termination ends.

* * * * *